US005482763A

United States Patent [19]

Shaffer

[11] Patent Number: 5,482,763

[45] Date of Patent: Jan. 9, 1996

[54] LIGHT WEIGHT TEAR RESISTANT FABRIC

[75] Inventor: Donald E. Shaffer, Wilmington, Del.

[73] Assignee: E. I. Du Pont de Nemours and Company, Wilmington, Del.

[21] Appl. No.: 380,531

[22] Filed: Jan. 30, 1995

[51] Int. Cl.[6] ..... B32B 5/08; B32B 25/10; D03D 1/00; D03D 15/00

[52] U.S. Cl. ..... 428/229; 139/420 R; 139/426 R; 139/420 A; 428/257; 428/258; 428/259

[58] Field of Search ..... 428/229, 257, 428/258, 259; 139/420 R, 426 R, 426 A

[56] References Cited

U.S. PATENT DOCUMENTS 4,900,613 4/1989 Green ..... 428/225

4,941,884 10/1989 Green ..... 8/120

FOREIGN PATENT DOCUMENTS 59-9053 1/1984 Japan ..... 25/27

62-26900 6/1987 Japan ..... 5/25

2025789 7/1978 United Kingdom .

*Primary Examiner*—James C. Cannon

[57] ABSTRACT

A light weight tear resistant fabric having a background fabric and reinforcing yarns selected such that the tensile strength of the reinforcing yarn is about two times that of the yarns of the background fabric and the elongation of the reinforcing yarns is at least two times that of the background fabric is described. The resulting reinforced fabric has at least 50% greater tear resistance than the background fabric as measured by the Elmendorf test.

10 Claims, 2 Drawing Sheets

COTTON WARP

COTTON FILL

REINFORCING YARN

LIGHT WEIGHT TEAR RESISTANT FABRIC

BACKGROUND OF THE INVENTION

Light weight, tear resistant, waterproof fabrics are desired for many end uses including but not limited to: tents, tarps, awnings and marine covers. In order to achieve a moisture barrier, fabrics have traditionally been very tightly woven or coated with a waterproofing resin. In either case, the fabric structure and individual yarns are immobilized and the tear strength is reduced, necessitating using a heavier than desired fabric for a particular use. Coated and tightly woven fabrics not only are heavy and difficult to use and store, but are also subject to tear, particularly along creases where the fabric has been folded.

In addition to waterproofing other fabric properties are of interest and can be achieved by proper selection of the fibers from which the fabric is woven and the use of additional treatments. For example, it has been desirable to make fabrics used for certain tents, tarps, awnings and the like out of blends which are predominantly cotton since cotton fabric will char and not melt when exposed to heat. Flame retardant additives are frequently added as treatments to these fabrics increasing their safety.

For fabrics used in applications such as tents, tarps, awnings and marine covers resistance to tearing is an important property. In previous attempts to increase the tear strength of such fabrics, yarns from high strength reinforcing fibers such as p-aramids, particularly fibers of poly(p-phenylene terephthalamide) PPD-T, have been incorporated into the fabric structure to improve the tear strength as described, for example, in Japanese Publication Kokoku Sho 62-26900 which discloses the use of from 1–40% of an aromatic polyamide yarn that is preferably at least 70% p-aramid and has a tensile strength of at least 15 gpd or alternatively, more than twice the tensile strength of the yarns of the fabric to be reinforced. Even with the use of such high strength yarns as those of PPD-T, Japanese Publication Kokoku Sho 62-26900 teaches that 2–5 adjacent ends of yarn are required to achieve adequate tear resistance.

An alternative method of improving the strength of a fiber has been to make intimate blends of the p-aramid staple with a natural staple fiber such as cotton or synthetic staple fibers such as nylon or polyester as disclosed in, for example U.S. Pat. No. 4,941,884 or U.S. Pat. No. 4,900,613. These references postulate that the best increase in tear strength is to be obtained by using a reinforcing yarn of maximum strength having low break elongation such as the p-aramid yarns.

Another alternative method of reinforcing the tear resistance of fabrics is disclosed in GB 2,025,789 where the tensile strength and the tear resistance of a coated fabric is improved by incorporating ends, either as single yarns or as groups of yarns, having higher strength and lower elongation than that of the background yarn in the weave of the coated fabric. GB 2,025,789 asserts that the lower elongation of the reinforcing yarn is a requirement for achieving a tear resistance improvement by enabling the stronger reinforcing yarns to take up the stress before the stress acts on the yarns of the background fabric.

SUMMARY OF THE INVENTION

The invention provides a light weight tear resistant fabric composed of a background fabric and meta-aramid reinforcing continuous filament yarn of comparable denier. The meta-aramid reinforcing yarn has an elongation that is greater than two times and preferably greater than three times that of the yarns of the background fabric and has a tensile strength that is about two times but at least 1.5 times that of the yarns of the background fabric. The reinforcing yarn can be incorporated into a woven or knitted background fabric by replacing a small percentage of the number of yarn ends per inch (2.54cm) of the background fabric with the reinforcing yarns.

Preferably the reinforced fabric is woven having the reinforcing yarn replacing warp and fill yarns of the background fabric such that the number of yarn ends per inch (2.54cm) of the reinforcing yarn is from 3 to 15% of the number of yarn ends per inch (2.54cm) in the background fabric. Yarns of the background fabric are replaced by reinforcing yarns in each the warp and fill direction. The resulting reinforced fabric is at least 50% stronger than the background fabric as measured by Elmendorf Tear Strength(ASTM D1424). The reinforced fabric can be treated by techniques known in the art to be made resistant to flame and water and still retain this tear strength advantage over the tear strength the background fabric without the reinforcement.

BRIEF DESCRIPTION OF THE DRAWINGS

FIG. I depicts the weave pattern of the background fabric.

FIG. II depicts a reinforced fabric of the invention. The reinforcing yarns are woven into the background fabric and replace yarns of background fabric in the warp and the fill directions.

DETAILED DESCRIPTION OF THE INVENTION

Figure 1:
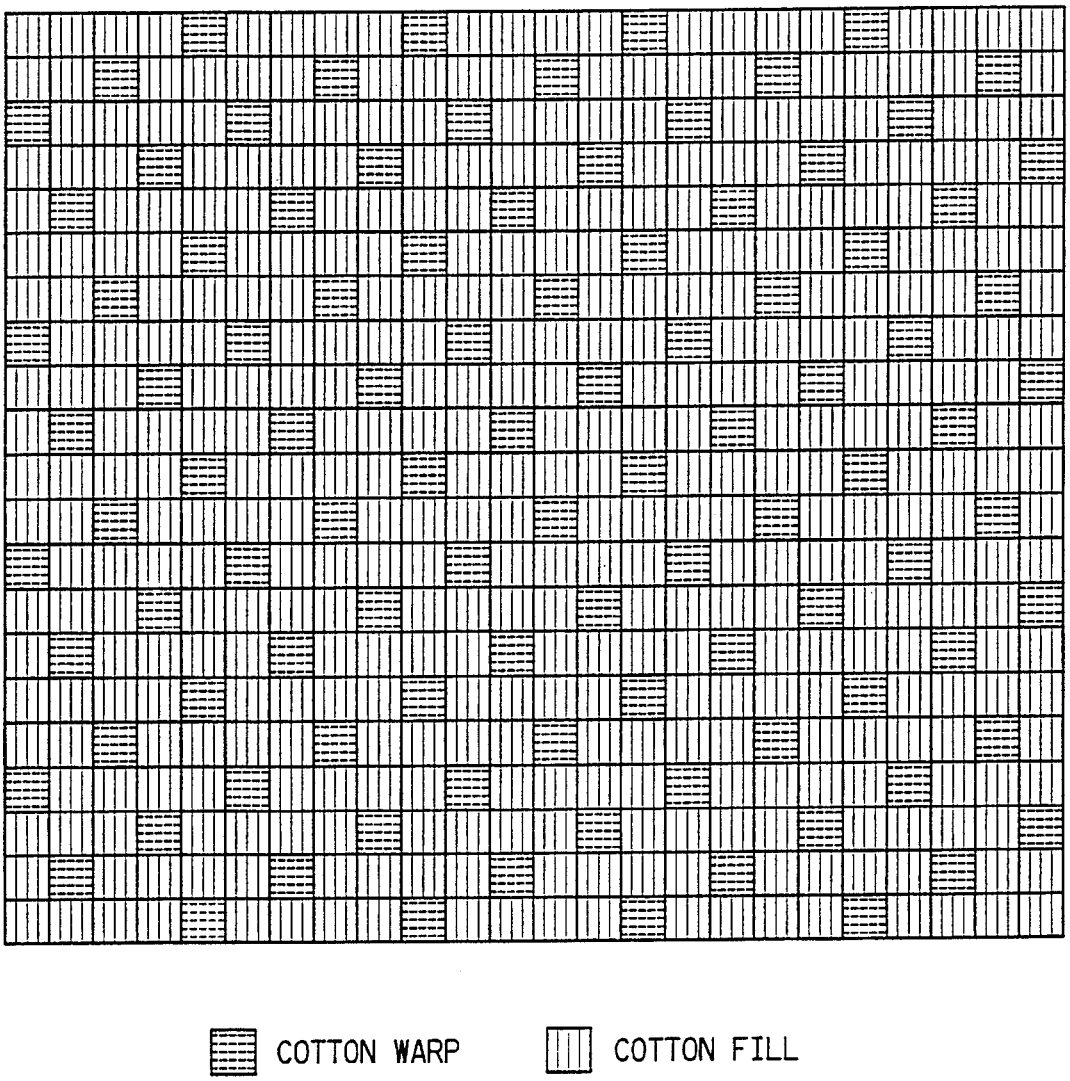
Figure 2:
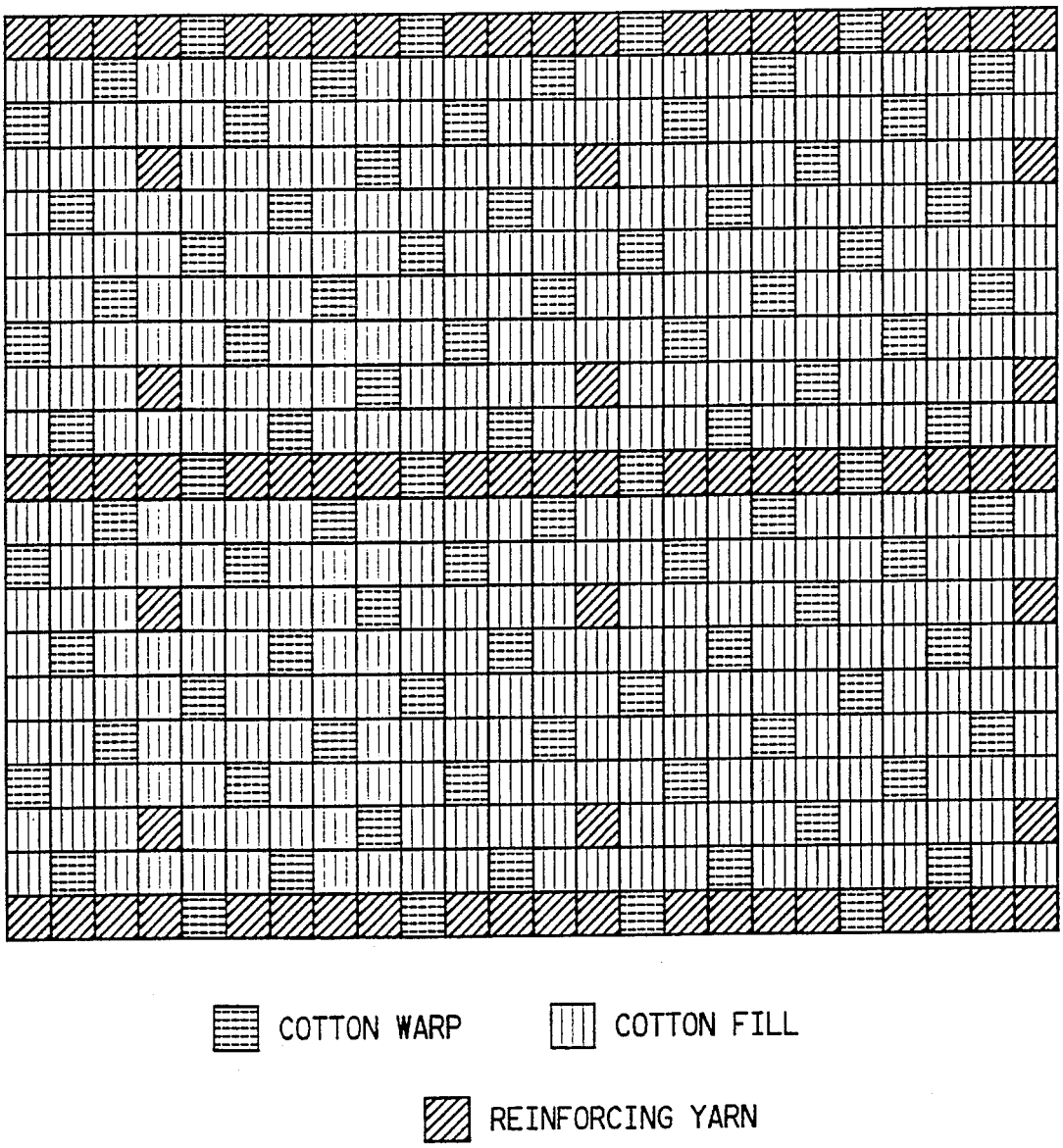

The detailed nature of the invention is best described with reference to the figures. FIG. I depicts a typical background fabric. Blocks containing horizontal dashed lines represent the warp yarns. Blocks containing the vertical solid lines represent the fill yarns. In this case, it is a weave known as a five harness satin but, the background fabric can be of any construction appropriate and practical for the contemplated use including fabrics that are knitted as well as woven.

A five harness satin, as represented in FIG. I, is preferred because it is a weave that already possesses good strength and can be reinforced to give a lightweight highly serviceable fabric. Such a weave can be more effectively treated for water and flame resistance.

The reinforced fabric of the invention is shown in FIG. II. The blocks containing horizontal dashed lines represent the warp yarns of the background fabric. The blocks containing diagonal dashed lines represent the position of the reinforcing yarns. Blocks containing the vertical solid lines represent the fill yarns of the background fabric. This is the same five harness satin weave of the background fabric, FIG I, except in this case every 10th end and pick of the background fabric is replaced by a single end of a reinforcing yarn. Replacement commonly means substitution of one yarn for another. In the case of the reinforcing yarn of the present invention, replacement also includes the meaning that a reinforcing yarn can be added to the weave or knit pattern of the background fabric.

This simple replacement results in a tear strength of the reinforced fabric is at least 50% more than that of the background fabric as measured by the Elmendorf Tear Strength Test. The resulting increase in tear strength of the reinforced fabric is of the same magnitude as that achieved by using the p-aramid yarn as taught in the prior art but, the reinforcing yarn of the present invention is a m-aramid such as poly(m-phenylene isophthalamide) MPD-I, whose tensile strength is only about 2 times that of the background yarns being reinforced and is only one third of the 15 gpd that is taught as the minimum required strength for the reinforcing yarns of the prior art.

In reinforcing a background fabric according to the present invention, it appears that the elongation of the reinforcing yarn allows the reinforcing yarns some limited movement so that they bunch up at the point of highest stress and provide resistance to the tear. For reinforcement of the fabric, reinforcing yarns must be placed into the background at a frequency of at least 3% of the total number of yarns per inch (2.54cm) of the background fabric. At a replacement rate of more than 15% of the background fabric yarn ends with the reinforcing yarns, the background fabric begins to loose its separate character and it begins to behave as a blended fabric.

The following example is illustrative of the invention but not intended to be limiting.

EXAMPLE 1

A reinforced tent fabric was woven according to MIL-C-12095G (a five harness satin) from combed cotton using a 40/2 cotton count yarn having MPD-I, 200 denier continuous filament yarn (available as Nomex T432 aramid fiber from E. I. du Pont de Nemours and Co.) replace every tenth end and pick of the background weave pattern. The resulting fabric, depicted in FIG. II is a fabric of the invention and contains 7.7 weight percent MPD-I reinforcing yarn replacing yarns of the background fabric at every tenth end and pick. The weight of this fabric was 7.0 oz/yd$^2$(237g/m$^2$).

A control fabric of 100% 40/2 combed cotton was woven according to MIL-C-12095G and was representative of a background fabric depicted in FIG. 1. The weight of this fabric was 6.5 oz/yd2(220g/m$^2$).

Comparison of the properties of the two fabrics after boil-off is given in Table I. Tensile strength was determined by ASTM D5034 and tear resistance was determined by ASTM D1424, the Elmendorf Tear Test.

TABLE I

Tensile and tear strength are reported in each of the warp, W, direction and the fill, F, direction. All properties are reported after boil-off.

| Property | Fabric Type | |
|---|---|---|
| | Reinforced | Control |
| Weight, oz/yd$^2$ | 6.5 | 7.0 |
| Ends × Picks | 100 × 85 | 100 × 88 |
| Weight % MPD-I | 7.7 | 0 |
| Break Strength Pounds, W/F | 108/93 | 100 × 100 |
| Tear Strength Pounds, W/F | 12/13 | 7.2 × 7.5 |

The reinforced fabric was then coated according to MIL-C-12095G and, the resulting tear strength and break strength were comparable to that of the uncoated reinforced fabric.

We claim:

1. A light weight tear resistant fabric comprising a background fabric woven from yarns and meta-aramid reinforcing yarns having a tensile strength that is at least 1.5 times and an elongation that is at least 2 times that of the yarns of the background fabric and being of comparable denier to that of the yarns of the background fabric wherein the number of reinforcing yarn ends per inch (2.54cm) is less than 15% of the number of yarn ends per inch (2.54cm) of the background fabric and the resulting reinforced fabric having a tear resistance that is at least 50% greater than that of the background fabric when measured by the Elmendorf Tear Strength Test.

2. The fabric of claim 1 wherein the meta-aramid reinforcing yarn is continuous multifilament poly(m-phenylene isophthalamide) and the background fabric is cotton sateen.

3. The fabric of claim 1 wherein the number of reinforcing ends per inch (2.54cm) is at least 3% but not more than 15% of the number of yarn ends per inch of the background fabric.

4. The fabric of claim 1 wherein every tenth yarn end in the warp direction and every tenth yarn end in the fill direction is a reinforcing yarn end.

5. The fabric of claim 1 wherein the fabric is treated for resistance to flame and water.

6. A light weight tear resistant fabric comprising a background fabric having warp and fill yarns in the warp and fill directions of the background fabric and reinforcing meta-aramid yarns having a tensile strength that is about 2 times that of the warp and fill yarns, an elongation that is at least 2 times greater than that of the warp and fill yarns and the reinforcing yarn having comparable denier to that of the warp and fill yarns wherein the reinforcing yarns replace warp and fill yarns of the background fabric such that the number of reinforcing yarn ends per inch (2.54cm) is at least 3% but less than 15% of the number of ends per inch (2.54cm) of the background fabric in each the warp and the fill direction.

7. The fabric of claim 6 where in the elongation of the reinforcing yarn is 3 times that of the yarns of the background fabric and the tensile strength of the reinforcing yarn is at least 1.5 times that of the yarns of the background fabric.

8. The fabric of claim 6 wherein the meta-aramid reinforcing yarn is continuous multifilament poly(m-phenylene isophthalamide) and the background fabric is cotton sateen.

9. The fabric of claim 6 wherein the every tenth yarn end in the warp direction and every tenth yarn end in the fill direction is a reinforcing yarn end.

10. The fabric of claim 6 wherein the fabric is treated for resistance to flame and water.

* * * * *